US005103628A

United States Patent [19]

Maeser et al.

[11] Patent Number: 5,103,628

[45] Date of Patent: Apr. 14, 1992

[54] APPARATUS FOR TRANSPORTING SPINNING TUBES TO AND FROM A TEXTILE SPINNING MACHINE, INCLUDING TUBE OBSTRUCTION MEANS

[75] Inventors: Martin Maeser, Albershausen; Norbert Stadele, Goppingen; Johann Balsasch, Oberkochen, all of Fed. Rep. of Germany

[73] Assignee: Zinser Textilmaschinen GmbH, Ebersbach/Fils, Fed. Rep. of Germany

[21] Appl. No.: 554,252

[22] Filed: Jul. 17, 1990

[30] Foreign Application Priority Data

Jul. 26, 1989 [DE] Fed. Rep. of Germany ..... 3924711

[51] Int. Cl.[5] ..... B65G 19/08; D01H 9/10

[52] U.S. Cl. ..... 57/281; 57/90; 198/733

[58] Field of Search ..... 57/281, 90; 198/419.3, 198/733

[56] References Cited

U.S. PATENT DOCUMENTS

| | | | |
|---|---|---|---|
| 3,307,340 | 3/1967 | Nishii et al. | 57/275 X |
| 3,737,021 | 6/1973 | Reth et al. | 198/419.3 |
| 4,964,269 | 10/1990 | Dinkelmann | 57/281 |

FOREIGN PATENT DOCUMENTS

| | | | |
|---|---|---|---|
| 1760689 | 2/1972 | Fed. Rep. of Germany . | |
| 3341895 | 5/1985 | Fed. Rep. of Germany . | |
| 3712027 | 10/1987 | Fed. Rep. of Germany . | |
| 3812342 | 10/1989 | Fed. Rep. of Germany . | |
| 2560655 | 9/1985 | France | 190/834 |

*Primary Examiner*—Daniel P. Stodola
*Assistant Examiner*—William Stryjewski
*Attorney, Agent, or Firm*—Shefte, Pinckney & Sawyer

[57] ABSTRACT

Apparatus for transporting spinning tubes mounted on peg trays for supply and removal of spinning tubes to and from spinning positions at opposite sides of a double-sided spinning machine comprises an endless upstanding conveyor belt extending about the machine. A plurality of transport members are affixed along two spaced transport sections of the belt each of a length corresponding to the spinning stations at the opposite machine side, for carrying peg trays with spinning tubes thereon. Obstruction elements are similarly affixed at spacings along the remaining extents of the belt to prevent receipt of peg trays therealong, whereby only the number of peg trays and spinning tubes required to supply the spinning positions of the machine are carried by the transport apparatus.

8 Claims, 4 Drawing Sheets

APPARATUS FOR TRANSPORTING SPINNING TUBES TO AND FROM A TEXTILE SPINNING MACHINE, INCLUDING TUBE OBSTRUCTION MEANS

BACKGROUND OF THE INVENTION

The present invention relates generally to apparatus for transporting spinning tubes to and from textile spinning machines and, more particularly, to an apparatus for transporting spinning tubes supported on tube support members for use in supplying empty spinning tubes to, and removing fully-wound spinning tubes from, a textile spinning machine of the type having multiple spinning stations.

Spinning tube transport apparatus of the aforementioned type are used in particular in textile spinning machines having spinning stations along each of two opposite sides thereof, e.g., 15 conventional ring spinning machines. Typically, such a transport apparatus utilizes a driven transport arrangement which travels alongside the spinning stations and includes a plurality of spaced transport members for engaging and transporting therewith support members, e.g., peg trays, on which spinning tubes are supported, thereby to align the tube support members in spaced relation corresponding to the spacing between the spindles of the spinning station. In such tube transport apparatus, peg trays carrying empty spinning tubes for supply to the spinning stations are delivered to the driven transport arrangement at an infeed location therealong and peg trays carrying fully-wound spinning tubes removed from the spinning stations are discharged from the driven transport arrangement at a spaced discharge location therealong.

West German Offenlegungsschrift DE 37 12 027 Al discloses a spinning tube transport apparatus wherein peg tray-type spinning tube support members are guided along a guide track extending in a U-shape about an associated spinning machine. A transport element is provided in the area of each of the spinning stations and is operative through a back-and-forth motion to move peg trays forwardly along the guide track. A mechanism is provided in association with the transport elements to move the peg trays only during a forward stroke of the back-and-forth motion of the transport element. The infeed and discharge locations for the peg trays are in the area of an end frame member of the spinning machine. In order to supply the spinning stations at both opposite longitudinal sides of the spinning machine with spinning tubes, the tubes must be guided around one end of the spinning machine. Thus, during an automatic bobbin exchange operation, empty spinning tubes supported on peg trays disposed along such portion of the guide track at one end of the spinning machine do not participate in the bobbin exchange operation and, accordingly, must be segregated following the exchange operation.

West German Patent Application No. P 38 12 342.8 discloses a spinning tube transporting apparatus wherein a transport arrangement in the form of an endless metal band or belt is directed about suitable guide or deflection rollers in a generally upstanding relation to travel along each opposite side of a spinning machine. The upstanding transport belt is adapted to engage and transport peg tray-type tube support members slidably along a guide track. In conventional fashion, each peg tray has a main plate-like body from which a central support pin extends upwardly for mounting of a spinning tube on the peg tray. The peg trays are aligned by the transport arrangement at spacings corresponding to the spacing of the spindles of the spinning machine, making it possible to exchange empty spinning tubes for fully-wound spinning tubes on the machine spindles by means of an automatic tube replacement apparatus.

In German Patent Application No. P 39 18 876.0 , a spinning tube transporting apparatus is disclosed which utilizes a driven transport arrangement having carrier elements affixed thereto to serve as support receptacles for tube-supporting peg trays. The transport arrangement includes guide elements which travel slidably in a guide track extending along the longitudinal sides of the spinning machine, the guide track having a guiding edge along which the support pins of the peg trays travel.

SUMMARY OF THE INVENTION

It is an object of the present invention to provide an apparatus for transporting spinning tubes, particularly when mounted on spinning tube support members such as peg trays, to and from the spinning stations of a textile spinning machine, which achieves an improved economy of operation.

According to the present invention, this objective is achieved by a transport apparatus which is equipped with a driven transport means arranged in endless form about the spinning machine to extend adjacent a tube infeed location and adjacent a tube discharge location and therebetween alongside the spinning stations of the spinning machine for conveying spinning tubes thereto. Specifically, the transport means includes an arrangement for receiving spinning tubes along a transport section of the transport means, which transport section has a lengthwise extent corresponding to the lengthwise extent of the spinning stations of the spinning machine. The transport means further includes an arrangement for preventing receipt of spinning tubes along another lengthwise extent of the transport means.

Advantageously, the provision in the present transport apparatus of obstruction elements controls the infeed of peg trays with empty spinning tubes to the transport means so that only a quantity of peg trays and spinning tubes necessary for a tube exchange operation are actually received and transported by the transport sections of the transport means. Thus, delays which occur in conventional transport apparatus due to the necessary segregation following a tube exchange operation of peg trays and spinning tubes which did not participate in the exchange procedure are therefore avoided in the present transport apparatus and, in turn, the operation of the present apparatus is particularly economical. Preferably, the endless transport means is driven by only a single drive motor or other drive unit which further contributes to the economical operation of the apparatus. The transport means can advantageously utilize an endless chain or belt. For example, a flexible steel or other metal belt can be utilized and oriented with its flat lateral extent in upstanding disposition for travel alongside the spinning stations of the spinning machine.

Typically and preferably, the present tube transporting apparatus will be adapted for use with a spinning machine having plural spinning stations along two opposite longitudinal sides of the machine. Accordingly, the tube receiving arrangement of the transport means preferably comprises a second transport section spaced from the first-mentioned transport section, the second transport section being of a lengthwise extent corresponding to the lengthwise extent of the spinning stations at one side of the machine. The tube preventing arrangement extends along the remaining length of the transport means between the first and second transport sections.

In the preferred embodiment, the tube receiving arrangement comprises a plurality of transport members at spacings along each transport section. Each transport member defines a recess at opposite leading and trailing sides thereof as viewed in the direction of travel of the transport means, the leading and trailing recesses of each pair of adjacent succeeding transport members being cooperative for receiving a peg tray or other compatible tube support member on which a spinning tube may be mounted. In this manner, the transport members are capable of independently supporting and carrying the peg trays, thereby eliminating any need for an auxiliary guide track or other support surface for the peg trays. Further, the transport members support the peg trays in a particularly protective manner and with minimal imposition of frictional forces on the peg trays.

The tube preventing arrangement preferably comprises a plurality of obstruction elements arranged along the intervening sections of the transport means between the transport sections. The obstruction elements have cooperative obstruction portions forming a substantially continuous obstruction surface, each obstruction element preferably comprising a first arm portion extending in the direction of travel of the transport means and another arm portion extending opposite the direction of travel of the transport means. The arm portions of the obstruction elements are vertically disposed at generally the same elevation as the recesses formed in the transport members along the transport sections of the transport means, with the respective first and second arm portions of successive obstruction elements being arranged in vertically overlapping relation to one another. In this manner, the arm portions of the obstruction elements collectively form a continuous uniform obstruction surface against which the first peg tray at the infeed location awaiting receipt by the transport means slides with minimal wearing thereof.

Preferably, the leading one of the transport members along the transport sections of the transport means is provided with a recess only at its trailing side and has an obstruction element at the leading side thereof. In this manner, the leading transport member along each transport section prevents a peg tray from being received in the area between the obstruction and transport sections of the transport means as the transport means passes the tube infeed location and, instead, the first peg tray at the infeed location is received in the recesses between the leading transport member and the next succeeding transport member of each transport section.

DESCRIPTION OF THE PREFERRED EMBODIMENT

Figure 1:
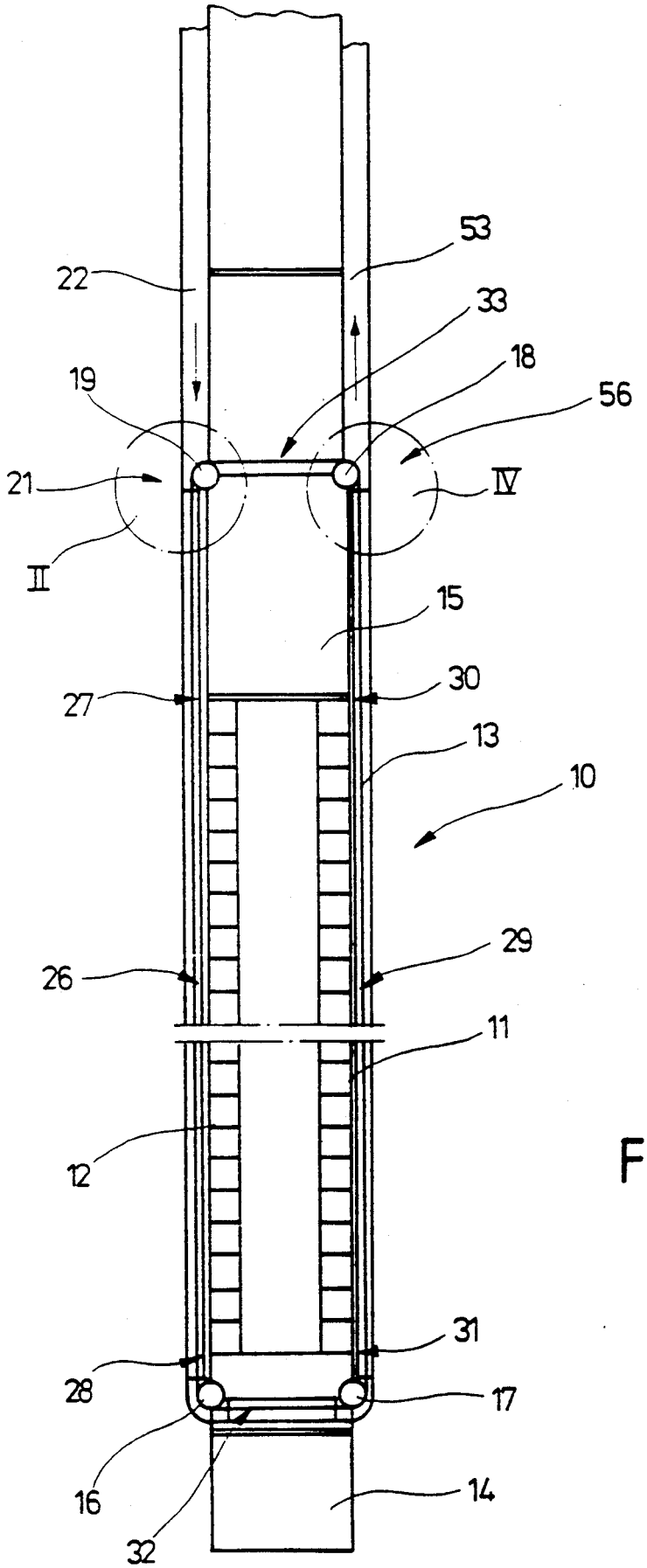
FIG. 1 is a schematic top plan view of a spinning tube transporting apparatus according to the present invention as preferably embodied for use with a conventional double-sided textile ring spinning machine.

Referring now to the accompanying drawings and initially to FIG. 1, a spinning tube transporting apparatus according to the preferred embodiment of the present invention is shown as preferably embodied in a textile ring spinning machine, broadly indicated at 10, of the conventional double-sided type having an elongated longitudinal frame with a plurality of spinning stations, shown only schematically spaced along each opposite longitudinal side of the machine between the opposite end frame members 14,15. At each such spinning station 11,12, spun yarn is wound onto empty spinning tubes, ultimately producing a spinning tube fully wound with the yarn. Thereupon, the fully-wound spinning tubes are replaced with empty spinning tubes for continuation of the spinning operation, the tube replacement or exchange operation most commonly being performed by an automatic tube exchange device or apparatus typically operative automatically to replace simultaneously multiple tubes at multiple respective spinning stations. Ring spinning machines and bobbin exchange apparatus of the described conventional type are well-known to those persons skilled in the art and need not be described more fully herein.

The present spinning tube transporting apparatus includes an endless driven belt 13 trained about toothed gear-type guide wheels 16,17,18,19 at opposite corners of the end frame members 14,15 of the spinning machine 10 to extend in endless fashion about the machine and alongside its spinning stations 11,12. The belt 13 preferably is an endless flexible steel or other metal belt having a substantially flat lateral extent and is oriented by the guide wheels with its flat lateral extent in generally upstanding relation facing the spinning machine 10, as shown in FIGS. 2–5. At least one of the gear-type guide wheels 16,17,18,19 is operatively connected to a drive motor or other suitable drive unit (not shown) for driving the belt 13 to travel about the spinning machine 10.

The transporting apparatus of the present invention is adapted for operation in connection with spinning tube support members 20 of the peg tray type having a circular disk-like main body 20' and a cylindrical mounting pin 23 upstanding centrally therefrom on which a spinning tube may be supported. Preferably, the pin 23 of each peg tray 20 is equipped with a cylindrical collar 23' of relatively enlarged diameter about the base of the upstanding pin 23. As more fully described below, the transport apparatus of the present invention is adapted to convey the peg trays 20 to and from the spinning stations 11,12 of the ring spinning machine 10 by the driven traveling movement of the belt 13. As shown in FIG. 1, peg trays 20 are delivered to the transporting apparatus at an infeed position 21 and are released from the transporting apparatus at a discharge position 56 respectively located at opposite sides of the spinning machine 10 at the end of its end frame member 15. The conveyance of peg trays 20 to the empty position 21 and from the discharge position 56 can be accomplished in any suitable manner, such as via infeed and discharge conveyor belts 22,53, respectively, oppositely driven as indicated by the directional arrows in FIG. 1.

According to the present invention, the present transport apparatus includes two transport sections extending lengthwise along the belt 13 at spacings from one another for carrying peg trays 20 with spinning tubes mounted thereon and two intervening obstruction sections extending lengthwise along the belt 13 between the respective leading and trailing ends of the transport sections for preventing receipt of peg trays and spinning tubes along such sections. Each such transport section has a lengthwise extent corresponding to the lengthwise extent of the spinning stations 11,12 at one side of the spinning machine 10. In FIG. 1, one such longitudinal transport section is indicated generally at 26 extending between points 27 and 28 on the belt 13 to have a total length equivalent to the lengthwise extent of the spinning stations 12. Likewise, the other lengthwise transport section is indicated generally at 29 extending between points 30 and 31 on the belt 13 to have a lengthwise extent corresponding to that of the spinning stations 11. The obstruction sections are indicated at 32 and 33, the obstruction section 32 extending along the belt 13 between points 28 and 31 and the obstruction section 33 extending along the belt 13 between points 30 and 27.

Figure 4:
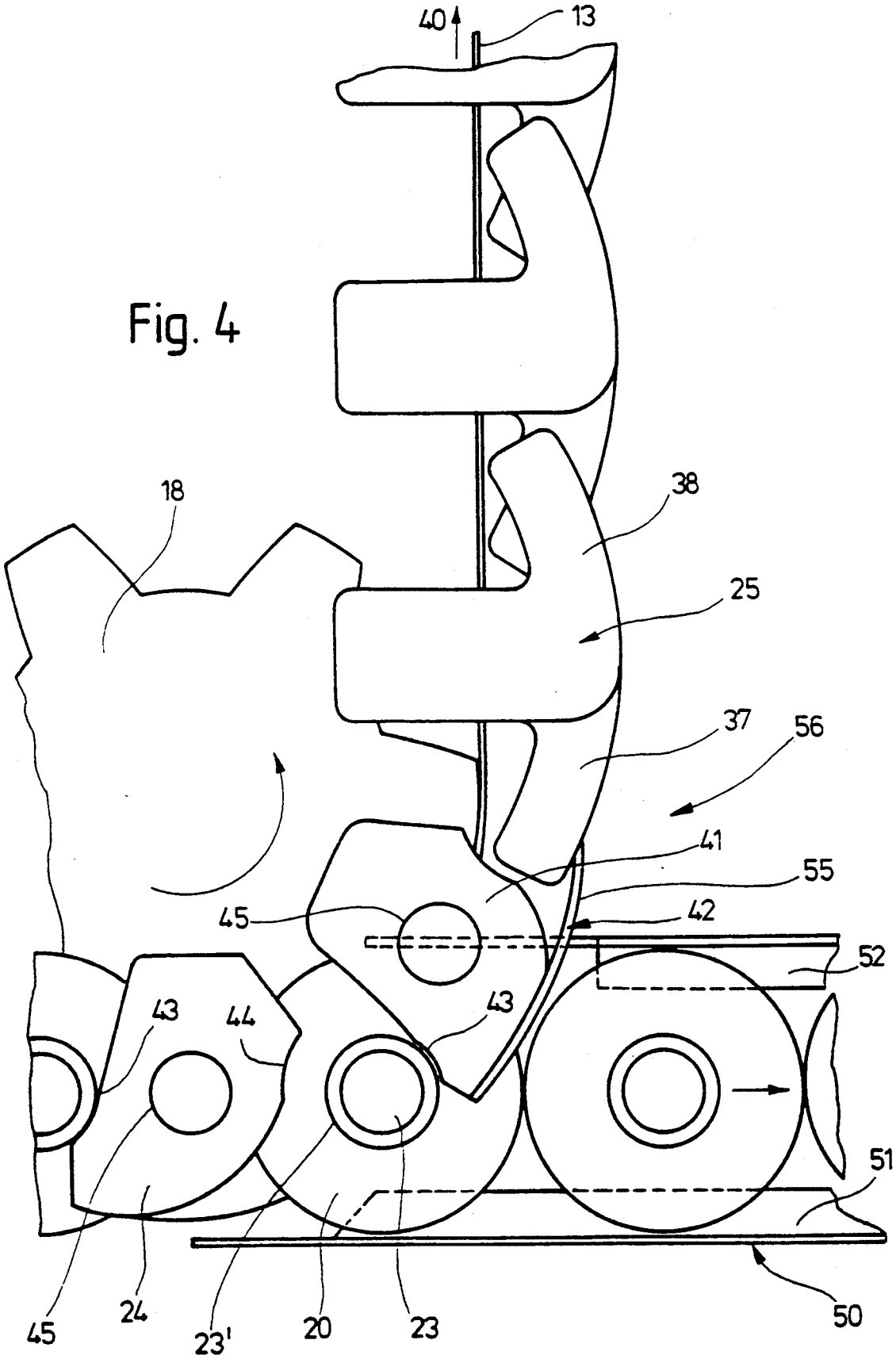
FIG. 4 is an other enlarged top plan view of a portion of the transporting apparatus of FIG. 1 shown at IV thereof, illustrating the location of interconnection between the trailing end of an obstruction section of the transport means and the leading end of a transport section of the transport means.
Figure 5:
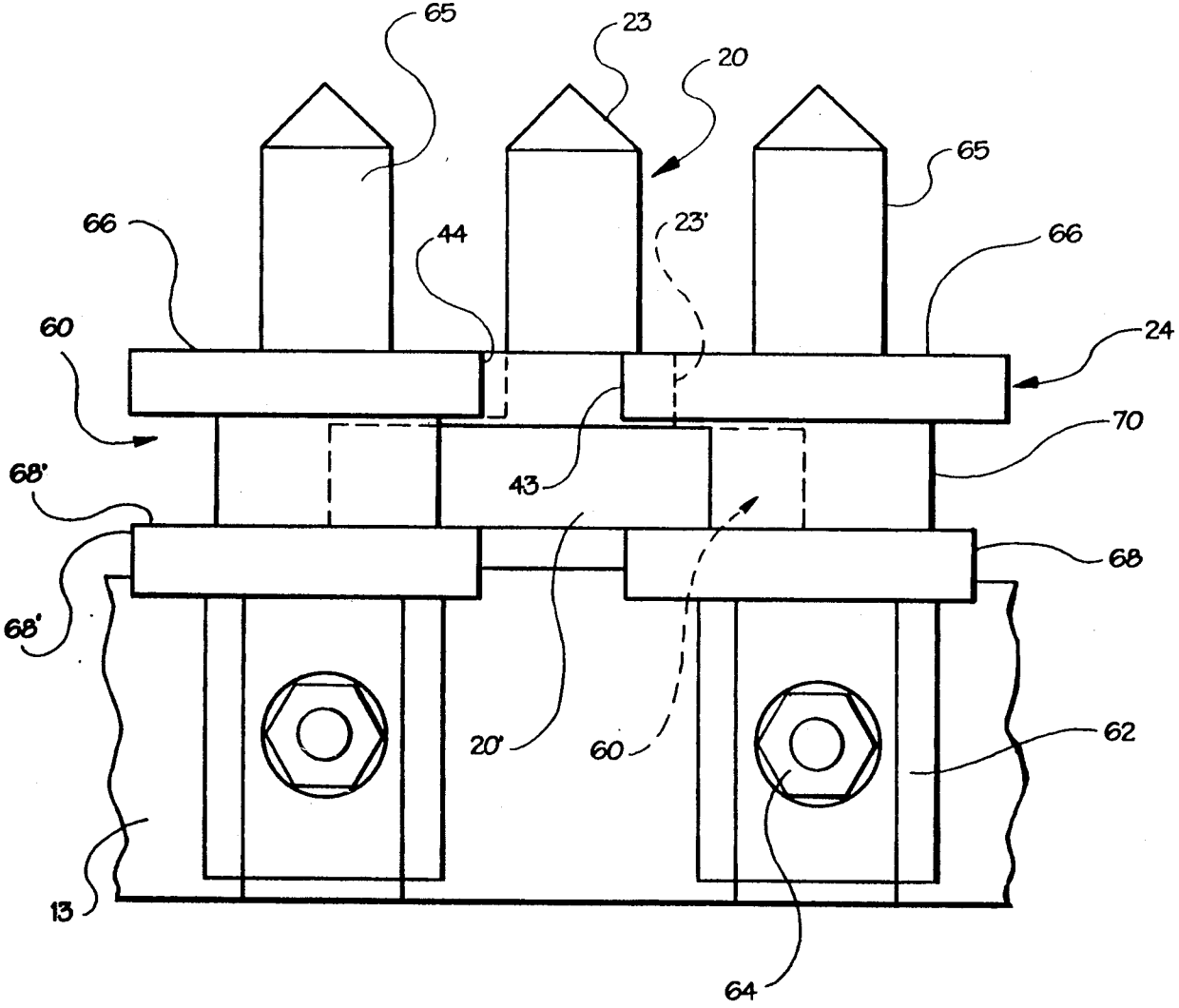
FIG. 5 is an enlarged side elevational view of a portion of a transport section of the driven transport means of the transporting apparatus of FIG. 1 as viewed at V of FIG. 4.

As best seen in FIGS. 4 and 5, along each transport section 26,29, a plurality of transport members 24 are affixed at respective foot portions 62 by fastening elements 64 to the outwardly facing surface of the belt 13 at uniform spacings therealong. The upper extent of each transport member 24 is of a generally U-shaped cross section comprising upper and lower plates 66,68 vertically spaced from one another by an intermediate connection portion 70 to define recesses 60 at the leading and trailing sides of the transport member 24, as viewed in its direction of travel with the belt 13. The leading and trailing recesses 60 of each pair of adjacent succeeding transport members 24 face one another and are configured to be cooperative to receive and support a peg tray 20 therebetween with its main body 20' disposed within the respective leading and trailing recesses 60 resting on the horizontally extending upper support surfaces 68' of the respective support plates 68 and with its collar portion 23' and mounting pin 23 extending upwardly between the respective plates 66. The leading and trailing edges of the upper plate 66 of each transport member 24, as viewed in the direction of travel thereof, include a concave arcuate edge portion at 43,44, respectively, which forms a guide surface, the respective leading and trailing guide surfaces 44,43, of each pair of adjacent succeeding transport members 24 being thereby located to face one another to define an enclosure area therebetween for engaging the collar portion 23' of a peg tray 20 to retain it in place between the transport members 24. In this manner, the transport members 24 convey peg trays 20 and spinning tubes supported thereon to the spinning positions 11,12 of the ring spinning machine 10 with the peg trays 20 and spinning tubes precisely aligned with one another and spaced apart in correspondence to the spacing of the spinning station spindles.

Each of the transport members 24 is equipped with a mounting pin 65 upstanding centrally from its upper plate 66, each pin 65 being of substantially the same configuration as the mounting pins 23 of the peg trays 20. As seen in FIG. 5, the mounting pins 65 on the transport members 24 extend upwardly to substantially the same height as the mounting pins 23 of the peg trays 20 in their transport dispositions supported between the transport members 24.

Figure 2:
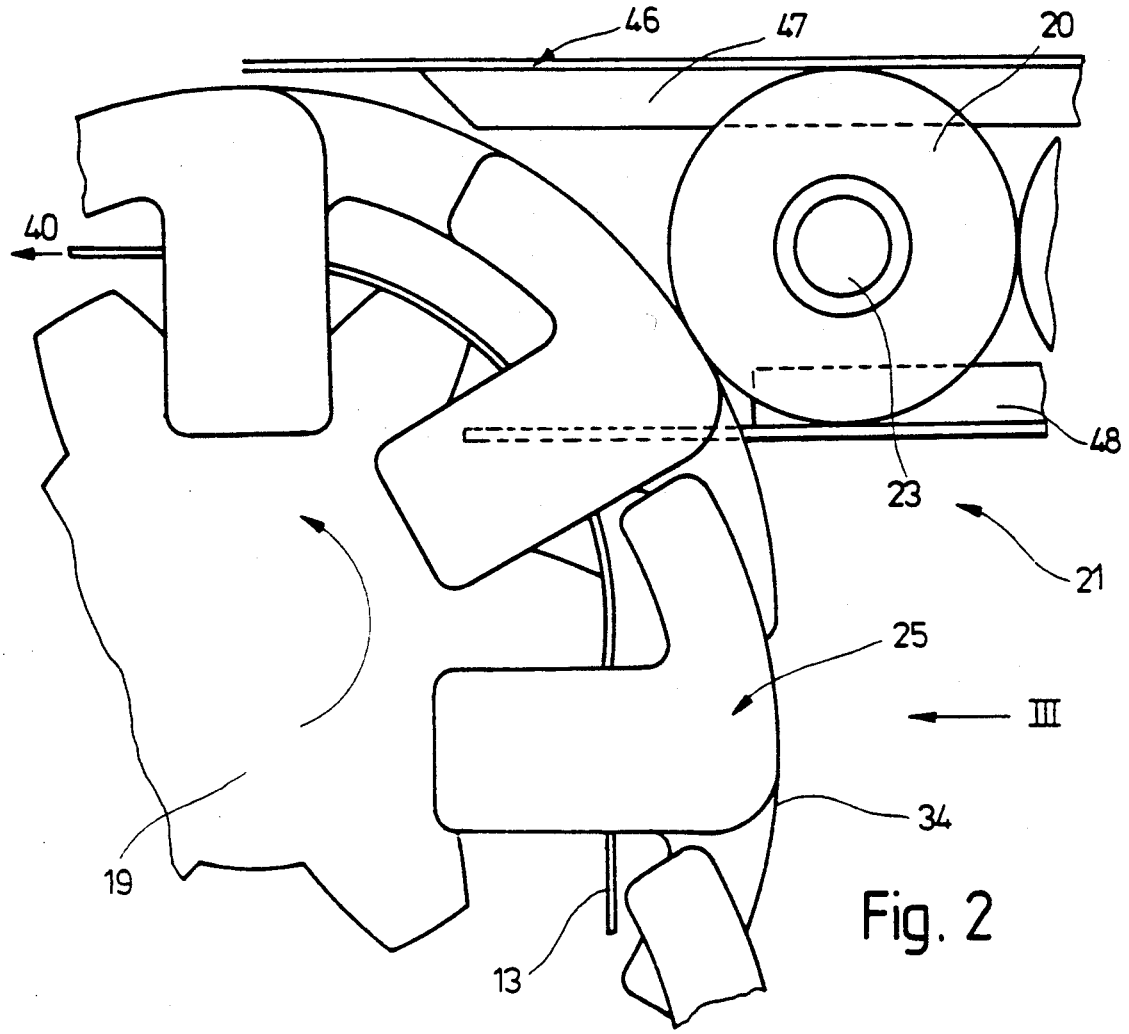
FIG. 2 is an enlarged top plan view of a portion of the transporting apparatus of FIG. 1 shown at II thereof, illustrating an obstruction section of the driven transport means.
Figure 3:
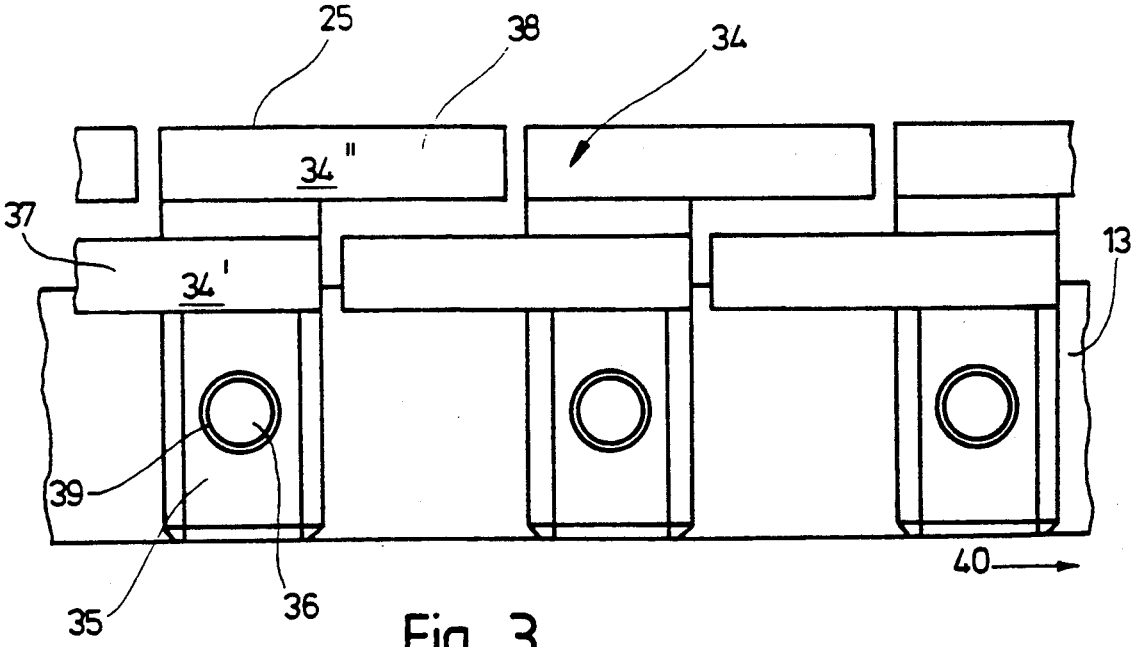
FIG. 3 is an enlarged side elevational view of a portion of the obstruction section of the transport means of the transporting apparatus of FIG. 1 as viewed at III of FIG. 2.

As shown in FIGS. 2 and 3, each obstruction section 32,33 includes a plurality of obstruction elements 25 each having a foot portion 35 with a bore 39 therethrough by which the obstruction elements 25 are affixed by fastening elements 36 to the outwardly facing surface of the belt 13 at uniform spacings therealong. In this manner, the obstruction elements 25 collectively form a continuous obstruction surface 34 which prevents the receipt of peg trays 20 and spinning tubes thereon by the endless transport arrangement along its obstruction sections 32,33. Specifically, each obstruction element 25 includes a pair of arms 37,38, the arm 38 of each obstruction element 25 extending in the direction of travel of the belt 13 indicated by the directional arrow 40 and the arm 37 of each obstruction element 25 extending opposite to the direction of belt travel 40. The arms 37,38 of adjacent succeeding obstructions elements 25 are arranged in vertically overlapping relation to one another to cooperate in an intermeshing fashion to form the continuous obstruction surface 34 by the outwardly facing arm surfaces 34',34'', respectively, of each pair of arms 37,38. Particularly, as shown in FIGS. 2 and 4, the surface contour of the continuous obstruction surface 34 is convexly curved outwardly from the belt 13 with the radius of convex curvature being generally adapted to the radius of deflection of the belt 13 about the gear-type guide wheels 16,17,18,19.

As best seen in FIG. 4, the leading one of the transport elements 24 along each transport section 26,29, as indicated at 41, is provided with an obstruction arm 55 which extends forwardly in the direction of belt travel 40, the arm 55 being convexly curved in corresponding manner to the obstruction elements 25 to present a similar outer obstruction surface 42. In this manner, the forward edge of the obstruction arm 55 cooperates with the arm 37 of the trailing obstruction element 25 of the preceding obstruction section 32,33. Each leading transport member 41 is provided with a peg tray-receiving recess 60 only at the trailing side of the transport member 41 facing the next succeeding transport member 24 for cooperation of such trailing recess 60 of the transport member 41 with the leading recess 60 of the next following transport member 24 to accept and carry a peg tray 20.

The foot portions of the transport members 24 (including each leading transport member 41) and the foot portions 35 of the obstruction element 25 serve as guide elements for guiding sliding movement in a guide track (not shown) together with other guide elements (also not shown) located at the opposite side of the belt 13, the guide track having appropriate guide surfaces to receive both horizontal and vertical forces applied to the endless transport arrangement to support the belt 13 and the transport members 24 and obstruction elements 25 thereon against horizontal and vertical deflection As illustrated in FIGS. 2 and 4, an infeed arrangement 46 is provided at the infeed position 21 for delivering peg trays to the present transport apparatus and, similarly, a discharge arrangement 50 is provided at the discharge location 56 for receiving peg trays released from the present transport apparatus. The infeed arrangement 46 extends from the infeed conveyor belt 22 to the infeed location 21 in substantial alignment to the path of travel of the belt 13 lengthwise of the spinning machine 10 alongside its spinning stations 12. Likewise, the discharge arrangement 50 extends from the discharge conveyor belt 53 to the discharge position 56 in substantial alignment with the path of travel of the belt 13 lengthwise of the opposite side of the spinning machine 10 alongside the spinning stations 11. The infeed arrangement 46 includes a pair of laterally spaced guide rails 47,48 and the discharge arrangement 50 similarly includes a pair of laterally spaced guide rails 51,52 for sliding movement therealong of peg trays 20.

In operation, peg trays 20 mounted with empty spinning tubes are transported by the infeed conveyor belt 22 and along the guide rails 47,48 to the infeed location 21. When the obstruction sections 32,33 of the endless transport arrangement are traveling through the infeed location 21 about the guide wheel 19, as illustrated in FIG. 2, the obstruction elements 25 prevent receipt of peg trays 20 from the infeed arrangement 46. On the other hand, when the transport sections 26,29 of the transport arrangement are traveling through the infeed position 21, the transport members 24,41 receive peg trays 20 one-by-one from the infeed arrangement 46 and carry the peg trays 20 between the transport members to the spinning stations 11,12 of the ring spinning machine 10 whereat the empty spinning tubes supported on the transported peg trays 20 may be automatically exchanged for fully-wound spinning tubes on the spindles of the spinning stations by means of an automatic tube exchange device (not shown). The fully-wound spinning tubes removed from the spinning stations onto the peg trays 20 are then transported to the discharge location 56, as shown in FIG. 4, whereat the peg trays 20 are released from the transport members onto the discharge arrangement 50 as the endless transport arrangement changes direction during travel about the guide wheel 18. The discharge conveyor belt 53 then transports the discharged peg trays 20 with the fully-wound spinning tubes thereon to another location for further processing.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for transporting spinning tubes for use in supplying empty spinning tubes to, and removing fully-wound spinning tubes from, a textile spinning machine having plural spinning tubes from, a textile spinning machine having plural spinning stations, said apparatus comprising driven transport means arranged in endless form about the spinning machine to extend adjacent a tube infeed location and adjacent a tube discharge location and therebetween alongside the spinning stations of the spinning machine for conveying spinning tubes thereto, said transport means having means for receiving spinning tubes along a transport section of said transport means, said transport section having a lengthwise extent corresponding to the lengthwise extent of the spinning stations of the spinning machine, and said transport means having means for preventing receipt of spinning tubes along another lengthwise section of said transport means, said another lengthwise section having a lengthwise extent at least greater than the lengthwise extent of a plurality of the spinning stations of the spinning machine.

2. Apparatus for transporting spinning tubes according to claim 1, wherein said apparatus is adapted for use with a spinning machine having plural spinning stations along two opposite longitudinal sides thereof, and characterized further in that said tube receiving means comprises a second transport section spaced from the first-mentioned said transport section, said second transport section being of a lengthwise extent corresponding to the lengthwise extent of the spinning stations at one side of the spinning machine, and said preventing means extending lengthwise therealong between said first and second transport sections.

3. Apparatus for transporting spinning tubes according to claim 1 and characterized further in that said preventing means comprises a plurality of obstruction elements arranged along said another section of said transport means.

4. Apparatus for transporting spinning tubes according to claim 1 and characterized further in that said tube receiving means comprises a plurality of transport members at spacings along said transport section, each said transport member defining a recess at opposite leading and trailing sides thereof in the direction of travel of said transport means, said leading and trailing recesses of each pair of adjacent succeeding transport members being cooperative for receiving a tube support member on which a spinning tube may be mounted.

5. Apparatus for transporting spinning tubes according to claim 4 and characterized further in that a leading one of said transport members in the direction of travel of said transport means comprises only one said recess at the trailing side thereof and an obstruction element at the leading side thereof.

6. Apparatus for transporting spinning tubes according to claim 1 and characterized further in that said tube receiving means comprises an obstruction element at the leading end of said transport section in the direction of travel of said transport means.

7. Apparatus for transporting spinning tubes according to claim 1 and characterized further in that said preventing means forms a substantially continuous obstruction surface.

8. Apparatus for transporting spinning tubes according to claim 7 and characterized further in that each said obstruction element comprises a first arm portion extending in the direction of travel of said transport means and another arm portion extending opposite the direction of travel of said transport means, the respective first and second arm portions of successive obstruction elements being arranged in overlapping relation to one another.

* * * * *